US006834732B2

(12) United States Patent
Haarstad

(10) Patent No.: US 6,834,732 B2
(45) Date of Patent: Dec. 28, 2004

(54) METHOD OF ASSESSING POSITIONAL UNCERTAINTY IN DRILLING A WELL

(75) Inventor: Ivar Haarstad, Trondheim (NO)

(73) Assignee: Den Norskestats Oljeselskap A.S., Stavanger (NO)

( * ) Notice: Subject to any disclaimer, the term of this patent is extended or adjusted under 35 U.S.C. 154(b) by 49 days.

(21) Appl. No.: 10/149,331

(22) PCT Filed: Dec. 7, 2000

(86) PCT No.: PCT/GB00/04667

§ 371 (c)(1),
(2), (4) Date: Jun. 6, 2002

(87) PCT Pub. No.: WO01/42621

PCT Pub. Date: Jun. 14, 2001

(65) Prior Publication Data

US 2003/0046005 A1 Mar. 6, 2003

(30) Foreign Application Priority Data

Dec. 8, 1999 (GB) ..... 9928881

(51) Int. Cl.[7] ..... E21B 7/04; E21B 47/022
(52) U.S. Cl. ..... 175/45; 175/61; 702/9
(58) Field of Search ..... 175/45, 40, 61; 702/9

(56) References Cited

U.S. PATENT DOCUMENTS 4,791,998 A * 12/1988 Hempkins et al. ..... 175/61
4,957,172 A 9/1990 Patton
5,103,920 A * 4/1992 Patton ..... 175/45
5,581,024 A * 12/1996 Meyer et al. ..... 73/152.03
5,901,795 A * 5/1999 Tsao et al. ..... 175/45
6,026,913 A * 2/2000 Mandal et al. ..... 175/45
6,389,360 B1 * 5/2002 Alft et al. ..... 702/9

FOREIGN PATENT DOCUMENTS

WO 96/35859 11/1996

OTHER PUBLICATIONS

Search Report—PCT/GB00/04667.
Preliminary Examination Report—PCT/GB00/04667.

* cited by examiner

*Primary Examiner*—Hoang Dang
(74) *Attorney, Agent, or Firm*—Patterson, Thuente, Skaar & Christensen, P.A.

(57) ABSTRACT

A method is provided for estimating the positional uncertainty in drilling a well such as an oil well. A first set of values is supplied representing a first three-dimensional uncertainty of the actual position of a drill bit with respect to the estimated position. A second set of values is supplied representing a second three-dimensional uncertainty of the actual position of a geological feature with respect to the estimated position thereof. For example, the first set of values relates to positional uncertainties because of the drilling procedure whereas the second set of uncertainties is associated with the obtaining and interpretation of seismic data. The first and second sets of values are combined to form a third set of values which represents a third uncertainty of the position of the drill bit with respect to the geological feature. A probability is then calculated from the third uncertainty and gives the probability that the drill bit will reach a predetermined position relative to the geological feature.

21 Claims, 6 Drawing Sheets

Probability
35
34
36
Net present value 40
39
41
38
37
2000
2002
2004
2006
2008
2010
2012
2014

Probability
45
43
42
44
Net present value

METHOD OF ASSESSING POSITIONAL UNCERTAINTY IN DRILLING A WELL

FIELD OF THE INVENTION

The present invention relates to a method of assessing positional uncertainty in drilling a well.

BACKGROUND OF THE INVENTION

In order to drill a well, it is necessary to define a geological target for the placement of the well. The geological target is a surface which is bounded by geological factors such as the position of geological faults and the extension of an oil-water contact. The geological target is defined by a geophysicist and is based on data about geological structures. Such data may be obtained, for example, in the form of seismic data or as data from nearby existing wells.

Some geological target boundaries are more important than others in the sense that it is more important to be inside some boundaries than others. For example, if a drill bit misses an oil zone, it will never be possible to produce oil. The geophysicist thus defines a reduced geological target whose boundaries are judged to be sufficiently remote from the boundaries of the geological target to ensure that there is a very good chance that the wellbore will not stray outside the geological target.

FIG. 1 of the accompany drawings illustrates such a conventional geological target 1 in the form of a rectangular surface having boundaries 2 to 5. Each of the boundaries 2 to 5 is associated with a risk in the form of a percentage associated with the drill bore straying outside the boundary. Thus, the risk of straying outside the boundary 2 should be no greater than 1% whereas the risks of straying outside the boundaries 3 to 5 should be no greater than 2.5%.

Within the conventional geological target 1 shown in FIG. 1, various geological structures are illustrated by way of example. A conventional reduced geological target 6 is also illustrated and this is defined by the geophysicist on the basis of experience.

Thus, the geophysicist judges how far the boundaries of the conventional reduced geological target 6 should be spaced from the boundaries of the conventional geological target 1. Because of the higher risk associated with the boundary 2, which corresponds to a geological fault, the corresponding boundary 7 of the conventional reduced geological target 6 is more remote than the boundary 8 with respect to the corresponding boundary 4.

The "risk values" shown in FIG. 1 as percentages are effectively the inverse of the acceptable probabilities of straying outside the respective boundaries. These values are generally referred to as "hardline values" and risks or probabilities are conventionally only assigned to boundaries which must not be crossed.

The geological data about the nature and location of structures beneath the surface of the earth are not precise; if such data were precise, then there would be no need for the conventional reduced geological target. There is a degree of uncertainty in the actual position of geological structures compared with the positions indicated by seismic and other data. This results in the need for the reduced target, whose purpose is to set an actual target for a driller to aim for during drilling of the well. The actual uncertainty in position varies from situation to situation but it is possible to provide some measure of the inaccuracy of the geological data. The geophysicist uses judgement in deciding the size and location of the conventional reduced geological target 6 within the conventional geological target 1.

Drilling of a well is also not a precise process. The geophysicist supplies the conventional reduced geological target 6 to a drilling engineer who must then define a drillers target within the conventional reduced geological target 6. The actual position of a drill bit compared with the measured or estimated position is also subject to inaccuracies. Such inaccuracies depend, for example, on the well trajectory geometry and the accuracy of drill position measuring equipment located behind the drill bit. The position measuring equipment can provide measurements of different accuracies depending on the type of measuring equipment and, in particular, on the cost thereof. A typical drillers target is shown at 9.

The drilling engineer has to define the drillers target such that, if the position of the drill bit is measured to be inside the drillers target, there is a predetermined likelihood that the well will actually be within the conventional reduced geological target 6 and hence, allowing for the inaccuracies in the geological data, the actual positioning of the well will be acceptable. The drilling engineer must judge whether more money should be spent on the drill position measuring equipment in order to improve the chances of drilling the well in the correct place.

SUMMARY OF THE INVENTION

The present invention may be characterized as a method of assessing positional uncertainty in drilling a well. Such a method may be used, for example, at the planning stage in order to direct the drilling operation and to assess whether it is worth while to drill a particular well. The method may also be used in real time to control the drilling of a well.

According to a first aspect of the invention, there is provided a method of estimating positional uncertainty in drilling a well, comprising supplying a first set of values representing a first three-dimensional uncertainty of the actual position of a drill bit with respect to the estimated position thereof, supplying a second set of values representing a second three-dimensional uncertainty of the actual position of a geological feature with respect to the estimated position thereof, combining the first and second sets of values to form a third set of values representing a third uncertainty of the position of the drill bit with respect to the geological feature, and calculating from the third uncertainty the probability that the drill bit reaches a predetermined position relative to the geological feature.

At least one of the first, second and third sets of values may comprise parameters of an error ellipsoid with a predetermined confidence interval referred to a Cartesian coordinate system.

At least one of the first, second and third sets of values may comprise a covariance matrix referred to a Cartesian coordinate system.

The first and second sets of values may be referred to different coordinate systems and the combining step may comprise transforming the first and second sets of values to fourth and fifth sets of values, respectively, referred to a common coordinate system and summing the corresponding values of the fourth and fifth sets to form the third set of values.

The probability may be calculated as a normal distribution.

The method may comprise defining a geological target as a finite surface and selecting a desired point of intersection of the drill path with the geological target. The method may comprise calculating the probability of the drill path intersecting the geological target. The geological target may be a polygon. The geological target may be rectangular. Each side of the polygon may be ascribed a maximum acceptable probability of the drill path missing the geological target on that side.

The method may comprise calculating the probability of the drill bit being at a predetermined distance from the geological target.

The method may comprise using information from a marker point whose relative position including positional uncertainty to the geological target is at least partly known to correct at least one of the first set of values. The marker point may be the position of the drill bit during drilling when the drill bit penetrates a seismic reflector whose distance from the geological target is at least partly known. The geological target may be selected to coincide with a predetermined geological structure, the marker point may be disposed at the predetermined geological structure, and the position of the predetermined geological structure may be derived from a pilot well. The marker point may be observed during drilling using means disposed at or adjacent the drill bit. Such means may, for example, comprise seismic, acoustic or electromagnetic means. The method may comprise defining a drill target as a sub-surface within the geological target and calculating the probability that the drill path directed at a point within the drill target will intersect the geological target. The method may comprise defining a drill target as a sub-surface within the geological target and calculating the lowest probability that the drill path directed within the drill target will intersect the geological target.

The method may comprise defining a drill target as a sub-surface within the geological target and calculating the total probability that the drill path directed within the drill target will intersect the geological target.

The method may comprise deriving a drill target as a sub-surface within the geological target whose boundary is defined by a predetermined probability.

The method may comprise defining a plurality of geological targets along an intended drill path, calculating the probability of the drill path intersecting each of the geological targets, and deriving from the calculated probabilities the probability of the drill path staying within a corridor defined by the geological targets.

According to a second aspect of the invention, there is provided a method of assessing the value of a well, comprising supplying details of a hydrocarbon reservoir, selecting an optimum point of intersection of a drill path with the reservoir, calculating the probabilities of the drill path intersecting the reservoir at a plurality of points using a method according to the first aspect of the invention, and calculating the probability distribution of the value of recoverable hydrocarbons for each of the points of intersection and deriving from the calculated probabilities and the probability distribution a distribution of the value of the well.

The drill may be partially withdrawn and the direction of drilling may be changed if the probability of the drill path intersecting the geological target following correction of the first set of values is less than a predetermined value.

It is thus possible to provide a technique which allows the uncertainties in the drilling of a well to be quantified in terms of probability. For example, when planning the drilling of a well, a geological target may be determined in the usual way with the appropriate hardline values being selected for the boundaries. Uncertainties in the actual positions of geological features compared with estimated or measured positions and uncertainties in drill bit position compared with estimated or measured position are combined to allow probabilities to be given, for example as to whether a selected intersection point with a geological target will be achieved. This allows the drillers target to be defined more accurately so as to improve the probability of correctly positioning a well. Also, the degree of accuracy of measurement of the drill bit position can be selected so as to achieve an acceptable probability of correctly positioning a well.

When combined with details of a hydrocarbon reservoir, it is possible to assess the commercial viability of the well and the need for more accurate drill bit positioning equipment when drilling the well. For example, if the structure of the reservoir is known or estimated, for example from geological data, the profitability of the well can be plotted as a function of probability and vice versa. The profitability of the well can be measured as the value of the hydrocarbon reserves which can be produced for a given position of the well head at the hydrocarbon reservoir minus the costs of production. The probability of the position of the well head can be assessed. This allows more informed decisions to be taken as to whether it is commercially worth while to extract the hydrocarbon reserves and what sort of measuring equipment should be used during drilling of the well.

These techniques may be used during the planning stage before beginning to drill a well. However, the present technique may also be used in real time during drilling. For example, the material withdrawn through the drill string during drilling can indicate when the drill bit has reached the position of a known type of rock. At that point, the position of the drill bit is known to greater accuracy and this can be used to correct the set of values representing inaccuracy of the position of the drill. Such information may be used to guide the drill so as to increase the probability of intersecting the geological target at a particular position. It may be determined that the drill is straying too far away from the desired trajectory, in which case the drill may be steered so as to return towards the desired trajectory. If the drill bit has strayed too far away from the desired trajectory for correction by steering to be possible, it is possible to withdraw the drill bit partially and then to recommence drilling in a different direction so as to return towards the desired trajectory.

BRIEF DESCRIPTION OF THE DRAWINGS

The present invention will be further described, by way of example, with reference to the accompanying drawings, in which.

Like reference numerals refer to like parts throughout the drawings.

DETAILED DESCRIPTION OF THE PREFERRED EMBODIMENTS

Figure 1:
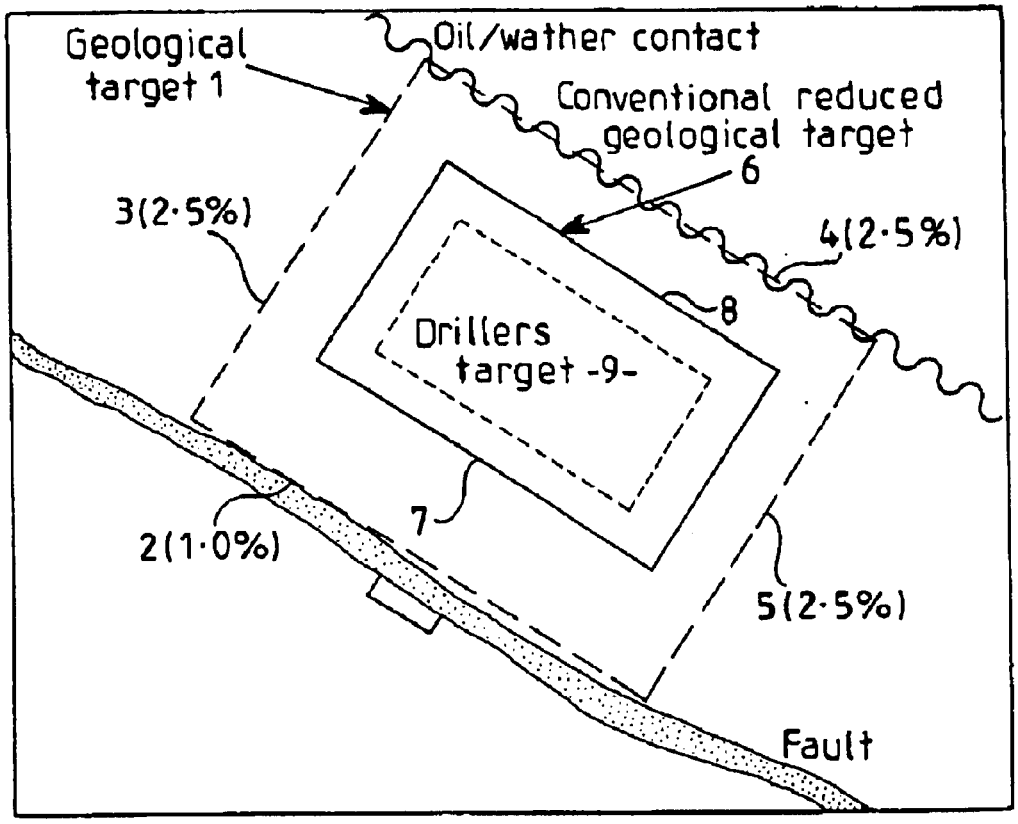
FIG. 1 is a diagrammatic plan view illustrating conventional geological and reduced geological targets.
Figure 2:
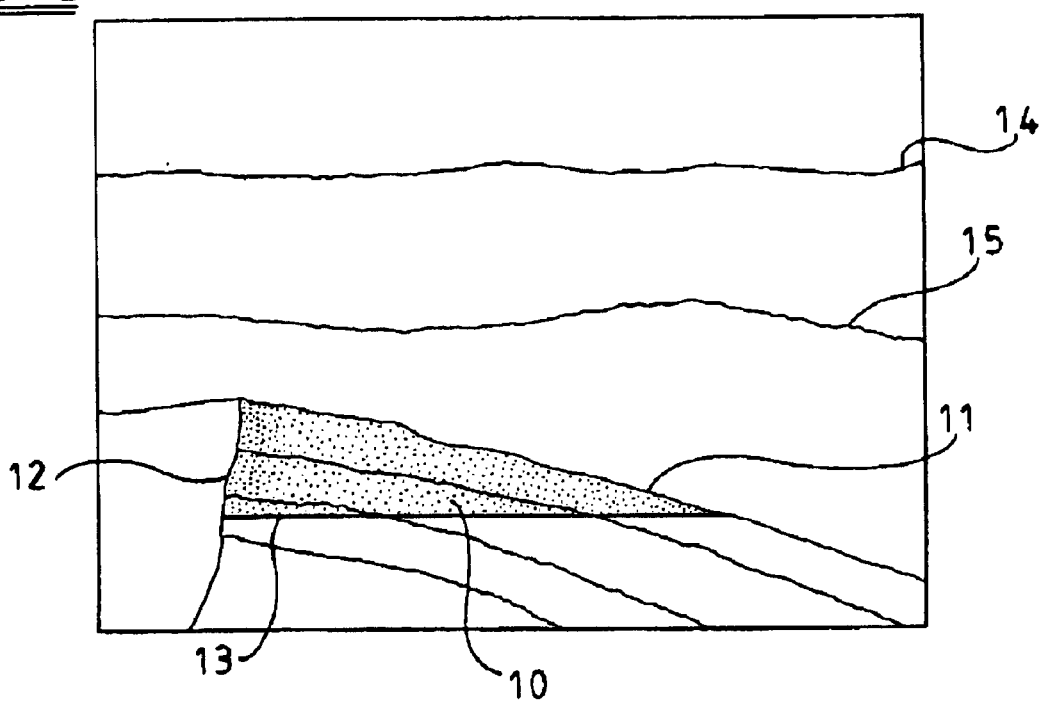
FIG. 2 is a cross-sectional diagram illustrating a vertical section with geological features representing a geological model.

FIG. 2 is a vertical cross-sectional view of a geological model of a region in which it is believed that an oil reservoir exists and in which the drilling of a well is to be considered. The reservoir is shown at 10 and is bounded by a cap formation 11, a fault 12, and an oil-water contact 13. The geological model is supplied, for example, from the result of a seismic survey of the region and includes two major reflectors 14 and 15 disposed above the reservoir 11. The reflectors 14 and 15 represent transitions from one type of rock to another so that intersection with each of the reflectors 14 and 15 can be detected during drilling from formation measurements and material removed from the drill string ("cuttings").

Figure 3:
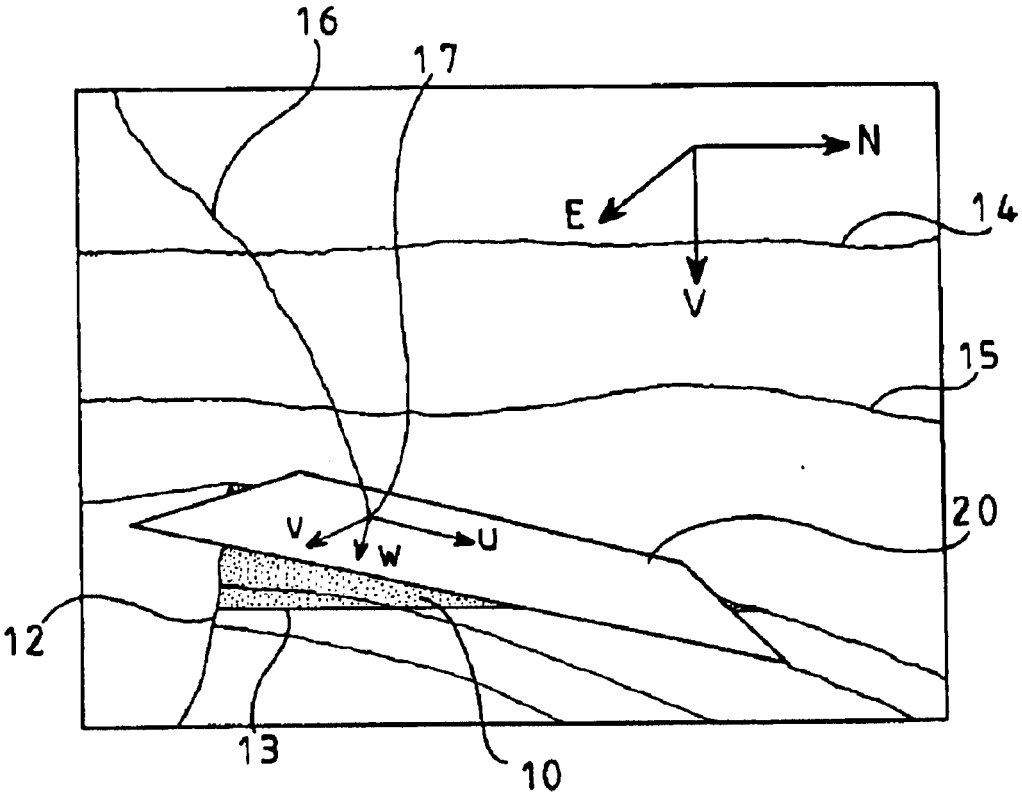
FIG. 3 is a view similar to FIG. 2 illustrating a geological target and a drill path.

FIG. 3 shows the model of FIG. 2 together with the desired drilling trajectory 16 and the main reference coordinate system NEV, where N is grid northing, E is grid easting and V is vertical position downwards (also referred to as true vertical depth or TVD). The coordinate system NEV is a three dimensional Cartesian orthogonal right-handed coordinate system and, for convenience, the origin of this coordinate system is assigned to the desired intersection point 17 of the well with the cap formation 11 which partially bounds the reservoir 10 from above.

A geological target for the well drilling operation is defined, for example in the form of a polygon, as illustrated at 20 in FIG. 3. Although the geological target may be defined in the NEV coordinate system, it is generally more convenient to define the geological target 20 in its own coordinate system uvw, which is also a three dimensional Cartesian orthogonal right-handed coordinate system. In this coordinate system, u is directed along the dip direction of the geological target 20, v is directed horizontally and w is perpendicular to the uv plane but is not used because the geological target 20 is contained within the uv plane. The orientation of the uvw coordinate system is described with respect to the NEV coordinate system by the azimuth $A_{zuvw}$ for the u and w axes (the plane uw is a vertical plane) and the inclination $Incl_{uvw}$ for the w axis. For convenience, the origin of the uvw coordinate system coincides with that of the NEV system and the desired point of intersection 17 of the well 16 with the geological target 20 at the cap formation 11.

Figure 4:
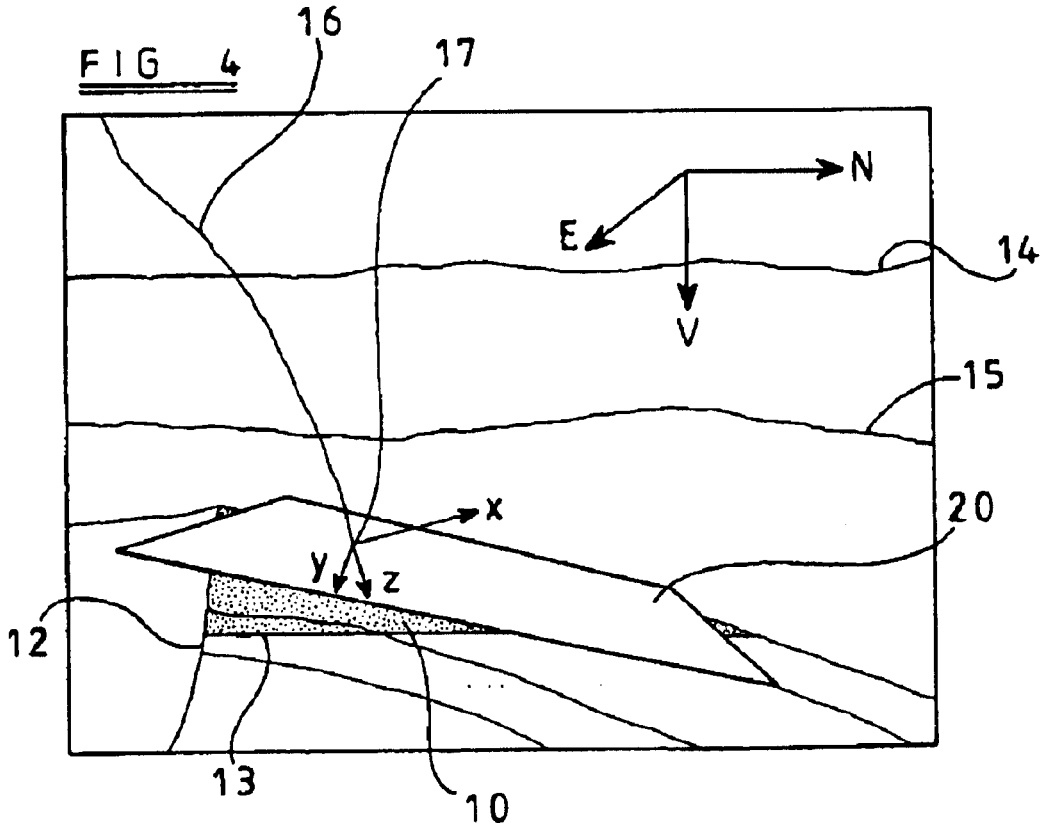
FIG. 4 is a view similar to FIG. 3 illustrating a driller's coordinate system.

A geophysist and a reservoir geologist define the optimal well intersection point 17 and the direction of the well in the reservoir as the azimuth (for example 33°) and the inclination (for example 40°) in the NEV coordinate system. As shown in FIG. 4, the well has a coordinate system xyz which is also a three dimensional Cartesian orthogonal right-handed coordinate system. In this system, x is directed upwardly (along the azimuth for a vertical well), y is directed horizontally to the right and z is directed downwardly along the well axis. The orientation of the xyz coordinate system with respect to the NEV coordinate system is described by the azimuth $Az_{xyz}$ for the x or z axis (the plane xz is a vertical plane) and the inclination $Incl_{xyz}$ of the z axis. Again for convenience, the origin of the xyz axis coincides with that of the uvw axis.

Figure 5:
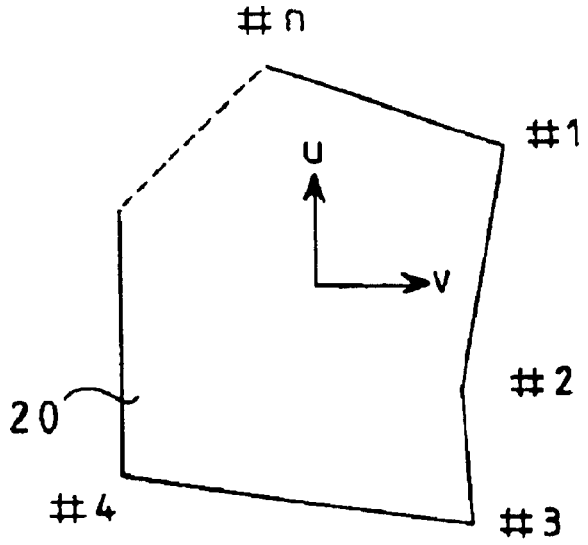
FIG. 5 is a diagram illustrating the nature of a geological target.

The actual shape of the geological target is determined by the geological formation and may be of any form. FIG. 5 illustrates a polygonal geological target 20 in the uv plane of the uvw coordinate system with the corners of the polygon being numbered in a clockwise direction. The position $POS_GEO_{uvw}$ of the geological target is specified in the uvw coordinate system by the positions of the corners and may be represented in matrix form as:

$$POS_GEO_{uvw} = \begin{bmatrix} u_1 u_2 \ldots u_n \\ v_1 v_2 \ldots v_n \\ w_1 w_2 \ldots w_n \end{bmatrix}$$

where the w coordinates are all equal to zero.

Figure 6:
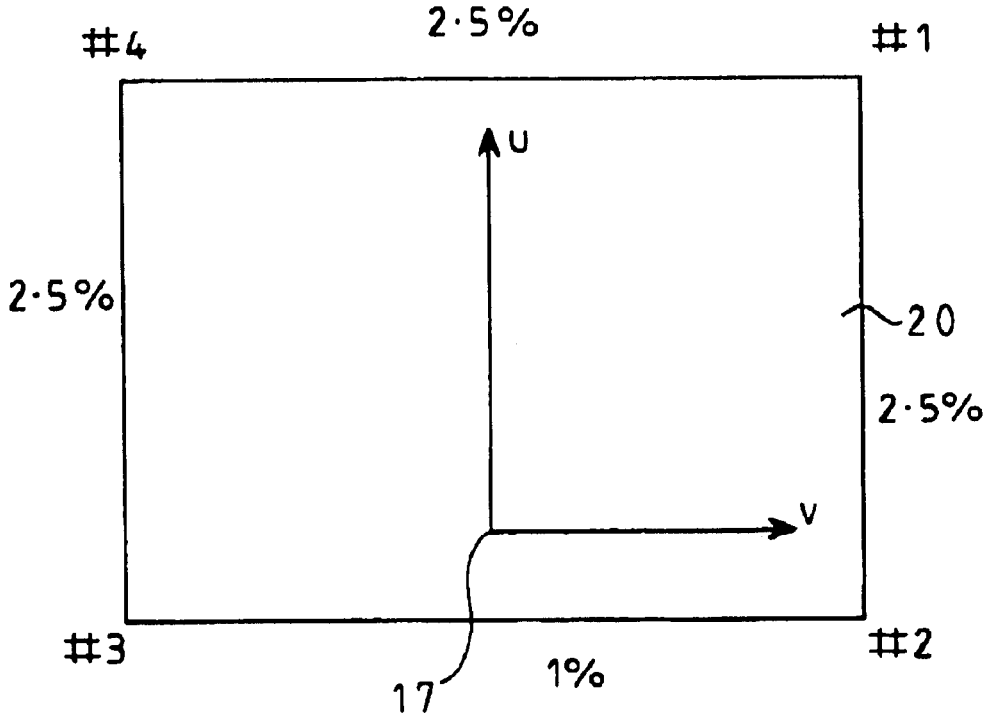
FIG. 6 is a diagram illustrating a specific example of a geological target.

By way of example, FIG. 6 illustrates a rectangular geological target 20 which is disposed parallel to the well azimuth. The size of the geological target 20 is specified with tolerance distances to the boundaries #1–#2, #2–#3, #3–#4 and #4–#1 from the desired intersection point 17 with the well.

Each of the sides of the geological target 20 is associated with a "hardline value" representing the maximum acceptable probability (in percent) of the well intersecting outside the respective side of the geological target 20. For example, the lower side #2–#3 may represent a fault having a risk value of 1% wheras the other sides of the geological target boundary are less critical and are associated with risk values of 2.5%. The tolerance distances and hardline values for a typical example of the geological target 20 are as follows:

| Geological Target | | |
|---|---|---|
| Target Line | Tolerance Distance | User specified Hardline value |
| #1–#2 | 100.0 | 2.5% |
| #2–#3 | 30.0 | 1.0% |
| #3–#4 | 100.0 | 2.5% |
| #4–#1 | 140.0 | 2.5% |

which may be represented in matrix form as:

$$POS_GEO_{uvw} = \begin{bmatrix} -30 & 140.0 & -30.0 & 140.0 \\ 100.0 & 100.0 & -100.0 & -100.0 \\ 0.0 & 0.0 & 0.0 & 0.0 \end{bmatrix}$$

where all distances specified herein are in meters.

A drillers target is specified as the target which a directional driller has to hit. Any position measured during drilling inside the drillers target is allowed. The shape of the drillers target can be of any form and may be represented as a plane within the uvw coordinate system. The size of the drillers target is determined by various factors such as the rock drillability, the well trajectory geometry and the directional drilling equipment being used. However, the drillers target is not based on any uncertainties in the geological model. The size of the drillers target is specified with tolerance distances to the boundaries from the intersection point.

The drillers target may also be described in the xy plane as the area within a polygon. The target is represented by the corners of the polygon ordered clockwise, in the same way as the geological target.

In order to calculate drilling position uncertainties, it is necessary to refer to a common coordinate system. This involves performing various coordinate transformations but only rotations are necessary. For example, in order to transform the drill bit position $POS_DR_{xyz}$ in the xyz coordinate system to the position $POS_DR_{NEV}$ in the NEV coordinate system, the following matrix formula is used:

$$POS_DR_{NEV}=ROT_{xyz}*POS_DR_{xyz}$$

where the rotation matrix $ROT_{xyz}$ is given by:

$$ROT_{xyz}=\begin{pmatrix} \cos A_{xyz}*\cos I_{xyz} & -\sin A_{xyz} & \cos A_{xyz}*\sin I_{xyz} \\ \sin A_{xyz}*\cos I_{xyz} & \cos A_{xyz} & \sin A_{xyz}*\sin I_{xyz} \\ -\sin I_{xyz} & 0 & \cos I_{xyz} \end{pmatrix}$$

The reverse transformation from the NEV coordinate system to the xyz coordinate system is given by:

$$POS_DR_{xyz}=ROT^{T}_{xyz}*POS_DR_{NEV}$$

because the rotation matrix is orthogonal and the inverse matrix is thus the transpose $ROT^{T}_{xyz}$ of the rotation matrix $ROT_{xyz}$.

Similar transformations may be performed between the uvw coordinate system and the NEV coordinate system.

Transformations between the uvw coordinate system and the xyz coordinate system can be simplified because all of the w and z values are equal to zero. Such transformations represent orthogonal projections. Transformations between these coordinate systems may be performed by setting all of the w and z values to zero and then performing the transformation in two steps via the NEV coordinate system.

In the following example, the geological target and drillers target are transformed to the xyz co-ordinate system. Rotation from the uvw coordinate system to the NEV coordinate system uses the rotation matrix:

$$ROT_{xyz}=\begin{pmatrix} \cos A_{uvw}*\cos I_{uvw} & -\sin A_{uvw} & \cos A_{uvw}*\sin I_{uvw} \\ \sin A_{uvw}*\cos I_{uvw} & \cos A_{uvw} & \sin A_{uvw}*\sin I_{uvw} \\ -\sin I_{uvw} & 0 & \cos I_{uvw} \end{pmatrix}$$

In the specific example of a maximum dip of 10° in an Azimuth of 33°, the rotation matrix is:

$$ROT_{uvw-NEV}=\begin{bmatrix} 0{,}826 & -0{,}545 & -0{,}146 \\ 0{,}536 & 0{,}839 & -0{,}095 \\ 0{,}174 & 0{,}000 & 0{,}985 \end{bmatrix}$$

The rotation from the NEV coordinate system to the xyz co-ordinate system is treated as described hereinbefore. The wellbore intersects the target plane with an azimuth of 33° and an inclination of 40°. This gives the transformation matrix:

$$ROT_{xuz-NEV}=\begin{bmatrix} 0{,}642 & -0{,}545 & 0{,}539 \\ 0{,}417 & 0{,}839 & 0{,}350 \\ -0{,}643 & 0{,}000 & 0{,}766 \end{bmatrix}$$

The resulting transformation from the uvw coordinate system to the xyz co-ordinate system is:

$$ROT_{uvw-xyz}=ROT^{T}_{xyz-NEV}*ROT_{uvw-NEV}$$

-continued $$ROT_{uvw-xyz}=\begin{pmatrix} 0{,}643 & 0{,}000 & -0{,}766 \\ 0{,}000 & 1{,}000 & 0{,}000 \\ 0{,}766 & 0{,}000 & 0{,}643 \end{pmatrix}$$

The geological target is transformed to the xyz co-ordinate system by:

$$POS_GEO_{xyz}=ROT^{T}_{uvx-xyz}*POS_GEO_{uvw}$$

so that:

$$\mathrm{POS_GEO}_{xyz}=\begin{pmatrix} 90{,}0 & -19{,}3 & 19{,}3 & 90{,}0 \\ 100{,}0 & 100{,}0 & -100{,}0 & -100{,}0 \\ - & - & - & - \end{pmatrix}$$

In order to calculate the drilling positional uncertainty, it is necessary to add drilling uncertainty values to geological uncertainty values. The drilling uncertainty values are specified, for example by a drilling engine engineer on the basis of the drilling equipment to be employed, the drilling geometry and the drillability of the rocks through which the well must pass. The drilling uncertainty values are estimated for the well at the target intersection point.

Similarly, the geological uncertainties are estimated at the target depth and are supplied, for example by the geologist and the geophysist. The geological uncertainties are derived, for example, from the quality of the seismic data and from the interpretation of the seismic data.

The present method bases calculations on variances and covariances. However, any type of accuracy measure may be used, such as covariance matrices, confidence ellipses or ellipsoids and standard deviations.

The standard way of representing the geological accuracy is by assuming that all boundaries are determined with the same accuracy characterised by the covariance matrix:

$$\sum_{\mathrm{pos_NEV}}=\begin{pmatrix} \mathrm{var}(N) & cov(N,E) & cov(N,V) \\ cov(N,E) & \mathrm{var}(E) & cov(E,V) \\ cov(N,V) & cov(E,V) & \mathrm{var}(V) \end{pmatrix}$$

So far, variables are assumed to be distributed in accordance with the normal or standard distribution. However, the calculations do not need to use the chi-square distribution (derived from normal distributed variables) and other distributions for the variables may be used.

The geological uncertainty is based on factors like seismic navigation and data quality, interpretation uncertainty and well tie-ins/calibrations. The calculations in this example are based on the covariance accuracy representation, and the numbers used are lateral/horizontal (40.0) and vertical (15.0) error (δ) as a one-dimensional (ID) 95% confidence interval.

$$Var(N)=Var(E)=(\delta_{LATERAL}/k^{1D}{}_{95\%})^2;\ k^{1D}{}_{95\%}=1.96$$

$$Var(V)=(\delta_{VERTICAL}/k^{1D}{}_{95\%})^2;$$

$$\sum \mathrm{POS_GEO}_{NEV}=\begin{pmatrix} \mathrm{var}(N) & 0 & 0 \\ 0 & \mathrm{var}(E) & 0 \\ 0 & 0 & \mathrm{var}(V) \end{pmatrix}$$

-continued $$\sum \mathrm{POS_GEO}_{NEV} = \begin{pmatrix} 413.4 & 0.0 & 0.0 \\ 0.0 & 413.4 & 0.0 \\ 0.0 & 0.0 & 58.1 \end{pmatrix}$$

In some situations, some of the target boundaries may have different accuracy: e.g. a fault is determined with a higher precision than the other boundaries and thus contributes to the calculation of hitting probabilities in a different way from the others. The actual form of representing the accuracy thus becomes:

$$\Sigma_{BOARDER_GEOwnc}$$

This way of utilising this information is not shown here.

It is important to apply the "while drilling" position uncertainty values based on the planned combination of gyro and magentic MWD survey tool runs prior to hitting the target, as well as to provide some distance prior to target intersection to allow for well trajectory adjustments.

The drilling error can be represented by a three dimensional (3D) error ellipsoid or as a horizontal ellipse and a vertical error with a specified confidence level:

Drilling Uncertainty

| Horizontal Error Ellipse | Error | Confidence Interval |
|---|---|---|
| Major Half-axis | 25.0 | 2D 95% |
| Minor Half-axis | 12.0 | 2D 95% |
| Direction of Minor Axis | 20.0° | |
| Vertical Error | | |
| TVD Error | 12.0 | 1D 95% |

In this example, all uncertainty parameters are assumed to have a normal distribution. The variables can be scaled according to confidence interval and dimension. The scaling values can be picked from a chi squared distribution.

$$Var_{MAJOR}=(\delta_{MAJOR\ HALF\text{-}AXIS}/k^{2D}{}_{95\%})^2;\ k^2{}_{95\%}=2.45$$

$$Var_{MINOR}=(\delta_{MINOR\ HALF\text{-}AXIS}/k^{2D}{}_{95\%})^2$$

$$Var_{TVD}=(\delta_{TVD\ Error}/k^{1D}{}_{95\%})^2;\ k^{1D}{}_{95\%}=1.96$$

$$AZ_{MAJOR}=\text{"Direction of Minor Axis"}+\pi/2$$

The 3D Error Ellipsoid can be transformed to the Covariance using the expressions:

$$var(N)=\cos^2(Azmajor)*Var_{MAJOR}+\sin^2(Az_{MAJOR})*Var_{MINOR}$$

$$var(E)=\sin^2(AZ_{MAJOR})*Var_{MAJOR}+\cos^2(Az_{MAJOR})*Var_{MINOR}$$

$$var(V)=Var_{TVD}$$

$$cov(N,E)=-\sin(Az_{MAJOR})*\cos(AZ_{MAJOR})*(Var_{MAJOR}-Var_{MINOR})$$

$$cov(N,V)=cov(E,V)=0$$

$$\sum \mathrm{POS_DR}_{NEV} = \begin{pmatrix} \mathrm{var}(N) & cov(N,E) & cov(N,V) \\ cov(N,E) & \mathrm{var}(E) & cov(E,V) \\ cov(N,V) & cov(E,V) & \mathrm{var}(V) \end{pmatrix}$$

The drilling survey covariance matrix is thus:

$$\sum \mathrm{POS_DR}_{NEV} = \begin{pmatrix} 33.4 & -25.8 & 0.0 \\ -25. & 894.7 & 0.0 \\ 0.0 & 0.0 & 37.2 \end{pmatrix}$$

Utilising the assumption that the drilling and the geological positions are independent variables, the compound accuracy becomes:

$$\Sigma_{POS_TOTAL}=\Sigma_{POS_GEO}+\Sigma_{POS_DR}$$

when the covariances are given in the same co-ordinate system.

The total covariance (error budget) for this example is:

$$\sum \mathrm{POS_TOTAL}_{NEV} = \begin{pmatrix} 446.8 & -25.8 & 0.0 \\ -25.8 & 508.2 & 0.0 \\ 0.0 & 0.0 & 95.3 \end{pmatrix}$$

Geological markers identified while drilling or pilot well information may provide stratigraphic control and improve the tie between the well and the surface seismic and geological model. As a result, a more favourable TVD uncertainty number at the target can be achieved.

A tie to a geological marker improves the accuracy in a direction normal to the marker plane. The covariance matrix must be transformed ($\mathrm{ROT}_{NEV_MARKER\ PLANE}$) to the plane before the error budget can be updated with the relative uncertainty:

$$\sum \mathrm{POS_TOTAL}_{MARKERPLANE} = \begin{pmatrix} \mathrm{var}(n) & cov(n,m) & 0.0 \\ cov(n,m) & \mathrm{var}(m) & 0.0 \\ 0.0 & 0.0 & cov_{MARKER} \end{pmatrix}$$

Then the matrix has to be transformed back to the NEV-plane.

The relative TVD error (ID 95% confidence interval) represents the estimated relative uncertainty from the geological marker to the target. The relative TVD error must include both the drilling and geological uncertainty (Square-Root-Sum of the uncertainties) at the target calculated from the reference point.

In this example, a relative TVD error from the marker of 4.0 (ID 95% confidence interval) is anticipated. The geological marker plane is also horizontal. The "new" total (relative) covariance for this example is:

$$\sum \mathrm{POS_TOTAL}_{NEV} = \begin{pmatrix} 446.8 & -25.8 & 0.0 \\ -25.8 & 508.2 & 0.0 \\ 0.0 & 0.0 & 4.1 \end{pmatrix}$$

Because of the linear relationship between co-ordinates in the different systems, the covariance propagates as:

$$\Sigma_{POS_TOTAL_{xyz}}=ROT^T{}_{xyz\text{-}NEV}*\Sigma POS_TOTALNEV*ROT_{xyz\text{-}NEV}$$

$$\sum \mathrm{POS_TOTAL}_{xyz} = \begin{pmatrix} 260{,}8 & 13{,}5 & 215{,}3 \\ 13{,}5 & 513{,}5 & 11{,}3 \\ 215{,}3 & 11{,}3 & 184{,}8 \end{pmatrix}$$

In order to determine hitting probabilities, all calculations are performed in the xy plane. This means that all the target information (co-ordintates and accuracies) are transformed into this system. The base for the probability calculations is that all the co-ordinate variables are Normal distributed.

The variance for a point along the axis$^t$ with a constrained direction$^a$ is given by:

$$\mathrm{var}(t) = (\cos\alpha\ \sin\alpha 0) * \sum \mathrm{POS_TOTAL}_{xyz} * \begin{pmatrix} \cos\alpha \\ \sin\alpha \\ 0 \end{pmatrix}$$

where t is a linear transform of the normal distributed x,y and z and thus becomes normal distributed itself. The complete distribution function is evident.

The following covariance matrix is used:

$$\sum \mathrm{POS_TOTAL}_{xyz} = \begin{pmatrix} \mathrm{var}(x) & cov(x, y) & cov(x, z) \\ cov(x, y) & \mathrm{var}(y) & cov(y, z) \\ cov(x, z) & cov(y, z) & \mathrm{var}(z) \end{pmatrix}$$

To obtain effective calculation formulae, the standard error ellipse parameter is found and the searching direction which gives maximum standard deviation is given by:

$$\theta_{\eta - arc\ tan}(2 - cov(x,y)/(var(x) - var(y)))$$

Maximum and minimum variances are given by:

$$q = ((var(x) - var(y))^2 + (2 * cov(x,y))^2)^{1/2}$$

$$var(\zeta) = 0.5 * (var(x) + var(y) + q)$$

$$var(\eta) = 0.5 * (var(x) + var(y) - q)$$

A point with co-ordinates xy is now transformed into the ζη system which is characterised by no statistical correlation between its axes.

$$\zeta = x * \cos(\theta) + y * \sin(\theta)$$

$$\eta = x * \sin(\theta) + y * \cos(\theta)$$

The probability density, f( ), for a point is now:

$$f(\ ) = r * e^{-0.5 * (\zeta^2/var(\zeta) + \eta^2/var(\eta))}$$

$$r = 1/(2 * \pi * \sqrt{\mathrm{var}(\zeta) * \mathrm{var}(\eta)})$$

In order to calculate the probability of intersection on the right side of a geological boundary, the standard deviation along the direction orthogonal to the actual border line is calculated. Further the distance from the point of interest to the border line is calculated. These two values are the input to a straightforward calculation of probability.

The var(t) can be scaled according to confidence interval and dimension. The scaling values ($k^{1D}{}_{n\%}$) to a given confidence interval can be picked from a normal distribution.

The "Hardline Value" is the one-sided distribution of the confidence interval:

$$\text{“Confidence Interval”} = 100\% - (P_{HARDLINE} * 2)$$

For example, for Target Line #1–#2:

$P_{HARDLINE}$=2.5%

"Confidence Interval"=100%−(2.5%*2)=95%;⇒$k^{ID}{}_{95\%}$=1.96

Minimum distance=sqrt (var(#1–#2)*$k^{ID}{}_{95\%}$)

In this example, this formula is used to calculate the minimum distance from the geological boundaries to the drillers target, using the total uncertainty and the "Hardline Values".

Geological and Drillers Target

| Target Line | User specified Hardline Value | Calculated minimum Distance (xy-plane) |
|---|---|---|
| #1–#2 | 2.5% | 44.6 |
| #2–#3 | 1.0% | 37.6 |
| #3–#4 | 2.5% | 44.6 |
| #4–#1 | 2.5% | 31.8 |

This gives the drillers target co-ordinates $$\mathrm{POS_DR}_{xyz} = \begin{pmatrix} 58{,}2 & 18{,}3 & 18{,}3 & 58{,}2 \\ 55{,}4 & 55{,}4 - & 55{,}4 & -55{,}4 \end{pmatrix}$$

which can be transformed to the uvw coordinate system by:

$$POS_DR_{uvw} = ROT_{uvx\text{-}xyz} * POS_DR_{xyz}$$

to give:

$$\mathrm{POS_DR}_{uvw} = \begin{pmatrix} 90{,}6 & 28{,}4 & 28{,}4 & 90{,}6 \\ 55{,}4 & 55{,}4 & -55{,}4 & -55{,}4 \\ 0 & 0 & 0 & 0 \end{pmatrix}$$

In this case, it is preferred to aim the wellbore to interest in the centre of the drillers target. This results a new coordinate for the wellbore with an offset with the new tolerance distances for the drillers target:

$$\mathrm{POS_WELL_OFFSET}_{NEV} = \begin{pmatrix} 49, 2 \\ 31, 9 \\ 10, 3 \end{pmatrix}$$

Drillers Target

| Target Line | Tolerance Distance uv-pane |
|---|---|
| #1–#2 | 55.4 |
| #2–#3 | 31.1 |
| #3–#4 | 55.4 |
| #4–#1 | 31.1 |

One method of computing the probability ($P_{HITO}$) of hitting the geological target is to divide the geological target into cells (e.g. an orthogonal grid covering the geological target with 100 cells in both x and y direction) and to do a numerical integration.

The steps in probability calculation for a given location in the xy plane comprise: Temporarily translating the origin for the distribution function to be in the actual point. Calculating the probability density for all cells within the target; and Calculating the hitting probability by summing the probability densities multipled with the cell size (area).

This method gives the hitting probability from one realisation of the planned drillbit coordinate. However, the hitting probability is changed by moving around in the drillers target. The hitting probability can be calculated for all points inside the drillers target and gives:

$$P_{HIT}(\text{Minimum})=95{,}1\%$$

$$P_{HIT}(\text{Target Centre})=99{,}91\%$$

This technique may be used to assess the value of a potential oil well before drilling begins so as to assess whether the cost of the well is likely to be justified by the profit and whether improved positional accuracy in drilling is likely to be justified by the likely increased profit.

Figure 7:
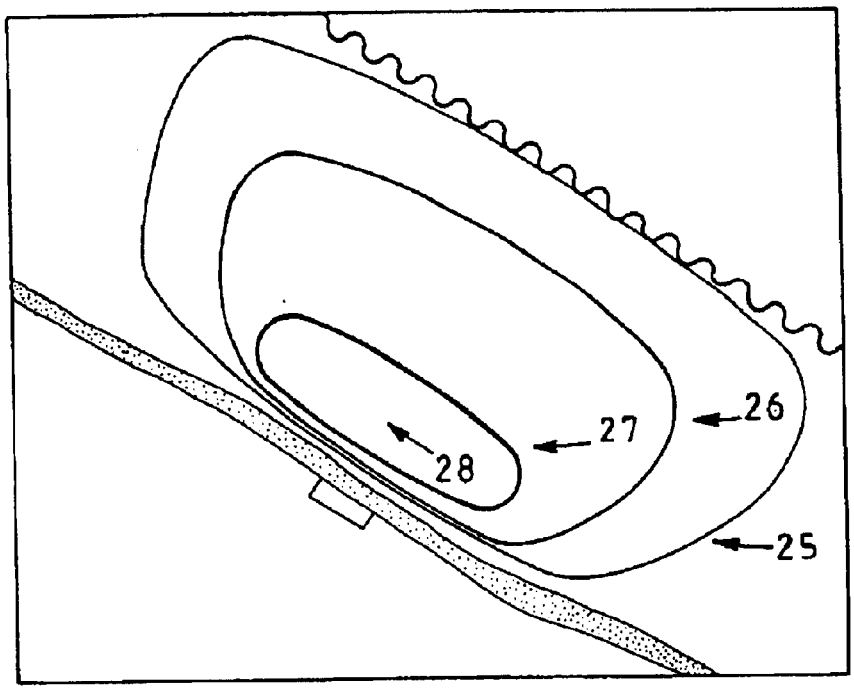
FIG. 7 is a contour map illustrating an example of an oil reservoir.

FIG. 7 is a horizontal contour map illustrating, from above, the measured position of an oil reserve. A contour 25 represents the horizontal edge of the reservoir i.e. corresponding to an oil layer thickness of zero. Contours 26 and 27 represent increasing constant thicknesses of the oil layer and a point 28 represents the top of the oil layer. In order to achieve maximum production from an oil well, it would be necessary for the drill path to intersect the reservoir at the point 28. Intersection at any other point within the boundary of the reservoir illustrated by the contour 25 would result in less than maximum oil production.

The technique described hereinbefore may be used to assess the probability of the drill path intersecting the reservoir at various points. Intersection at each point is associated with an expected value corresponding to the amount of oil likely to be produced. A probability distribution of the value of recoverable hydrocarbons for each of the points is thus calculated and this allows the distribution of the value of the well to be calculated.

Figure 8:
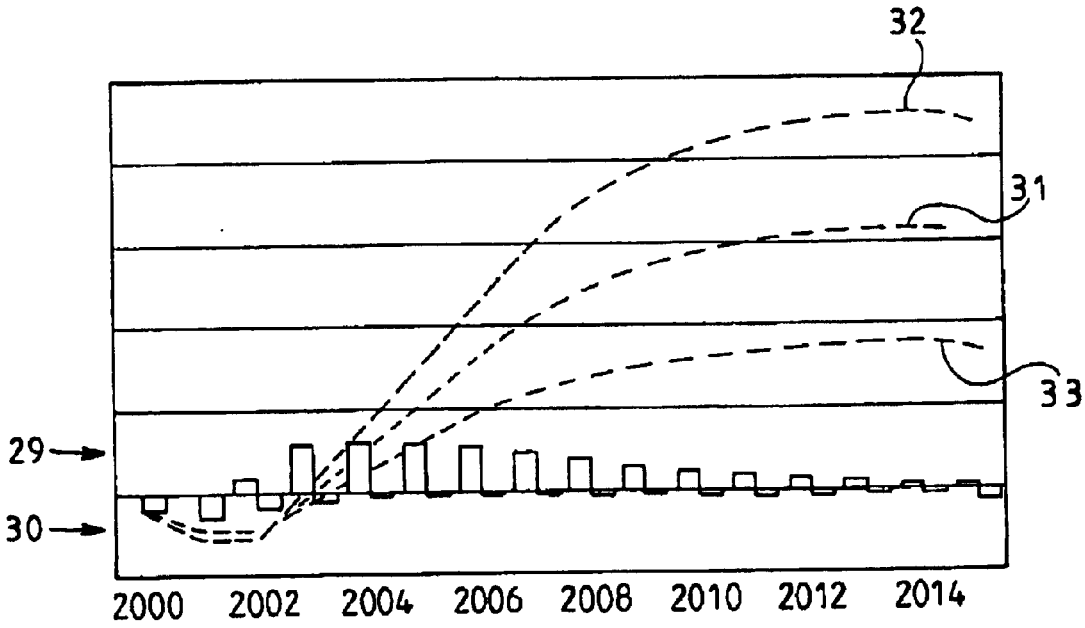
FIGS. 8A and 8B show histograms and graphs relating to the economics of producing oil from the reservoir illustrated in FIG. 7.
Figure 8B:
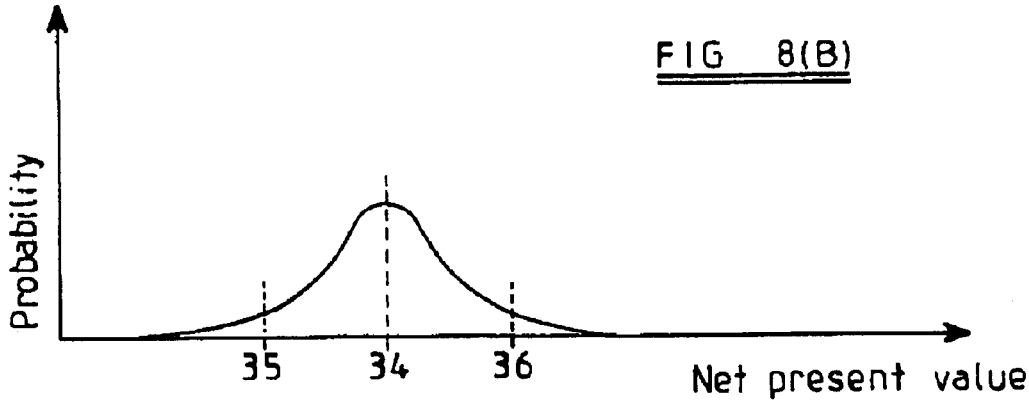

FIG. 8A illustrates a histogram of the cost 30 of finding, planning, drilling and producing from a well and the value 29 of oil recovered in arbitrary units against time in years. The cost and value are accumulated and referred to as Net Present Value (NPV) for the prospect. The expected value for a probability of 50% is illustrated by the curve 31. Uncertainties in all values may also be integrated and are shown for 10% probability by the curve 32 and for 90% probability by the curve 33. FIG. 8B illustrates probability against NPV in the form of a distribution with the expected value for probabilities of 50, 10 and 90% being indicated at 34, 36 and 35, respectively. This analysis may be performed before drilling commences so as to assess whether the well is likely to be commercially worthwhile.

Figure 9A:
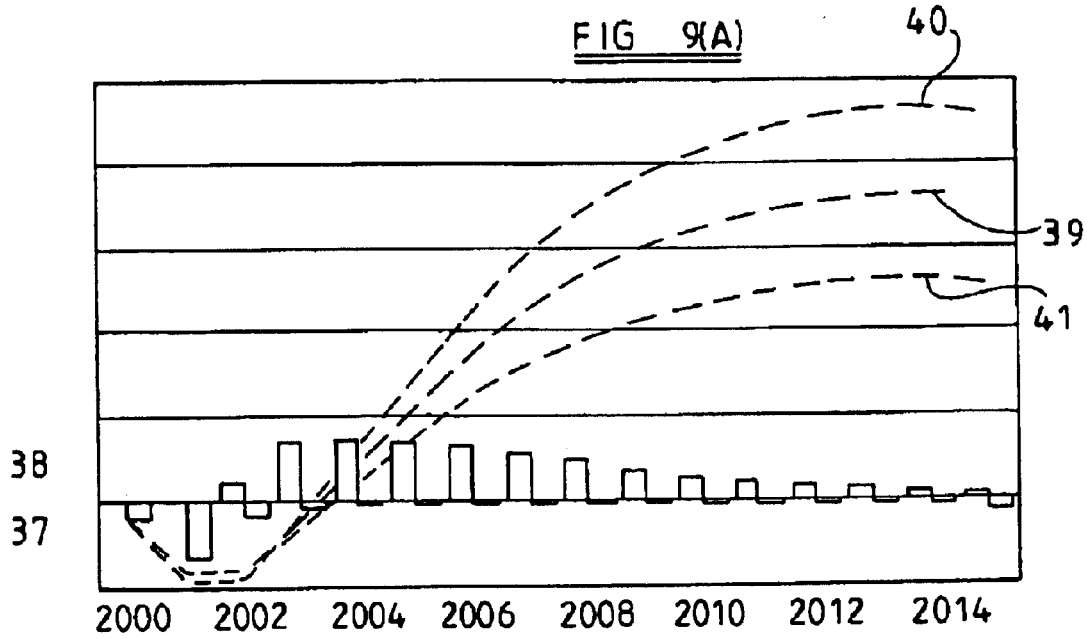
FIGS. 9A and 9B are similar to FIGS. 8A and 8B but illustrate the effect of using more accurate drill positioning equipment.
Figure 9B:
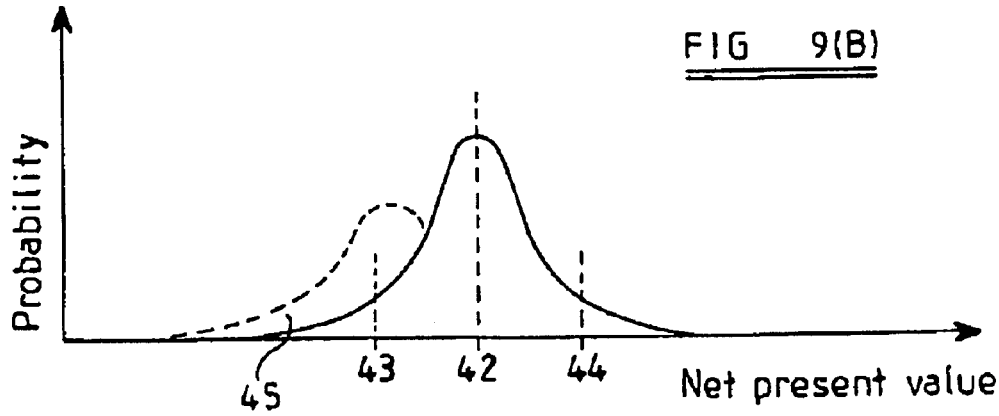

The analysis may be repeated under different conditions. For example, by using more accurate positioning equipment in the drill bit, drilling inaccuracies can be reduced so as to improve the probability of achieving larger production from the well. FIGS. 9A and 9B illustrate the effect of using more accurate positioning equipment. The initial cost 37 of the more expensive equipment is higher but the likelihood of greater production 38 from the well is substantially increased. The new integrated NPV is illustrated at 39 with the other uncertainty levels illustrated at 40 and 41 (corresponding to 32 and 33 in FIG. 8A). This is also illustrated in FIG. 9B where the expected value 42 is higher than that of FIG. 8B with the other uncertainties 43 and 44 corresponding to 35 and 36 in FIG. 8B. For comparison, the distribution of FIG. 8B is illustrated in broken lines at 45 in FIG. 9B.

Figure 10:
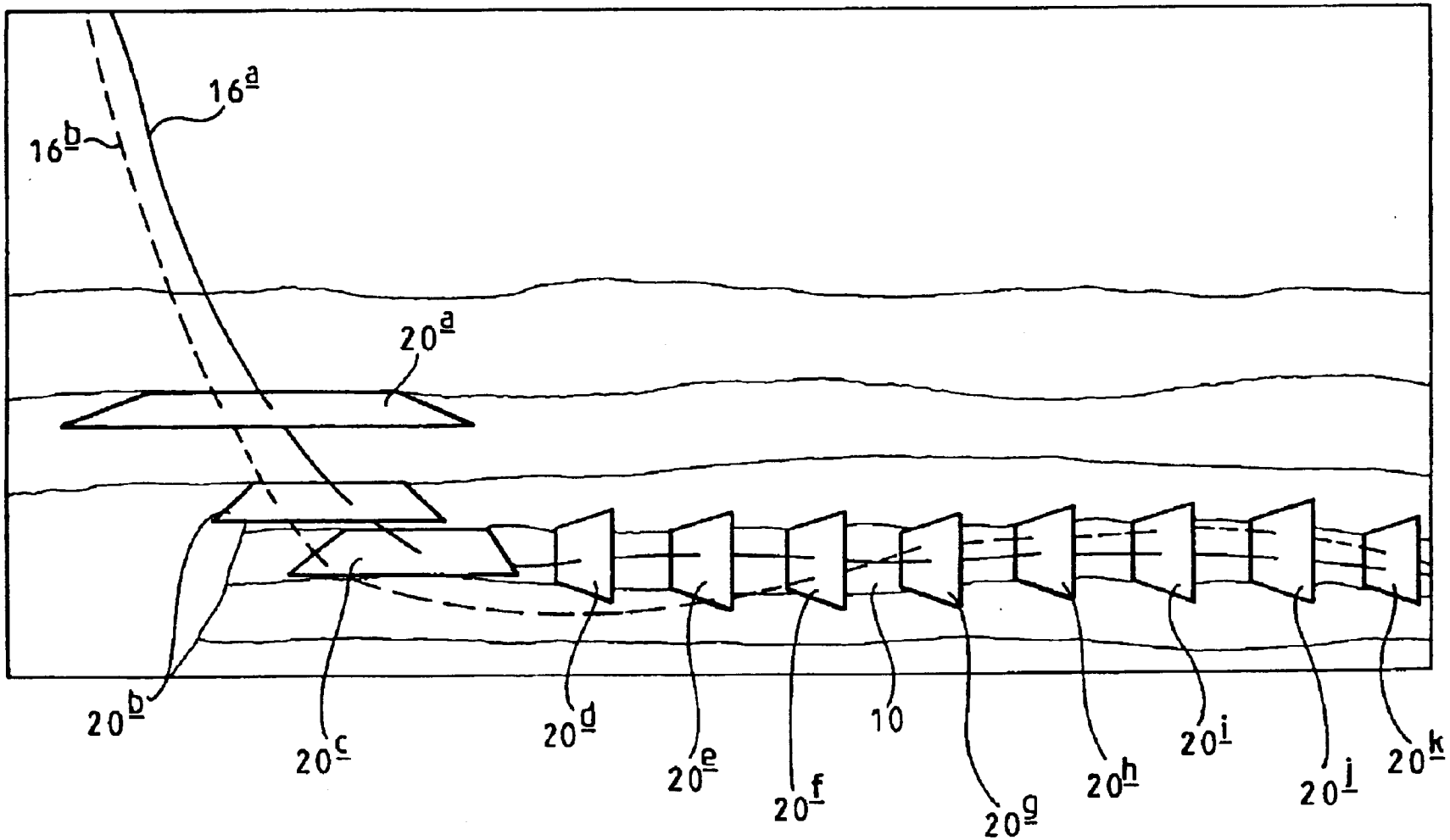
FIG. 10 illustrates the use of a plurality of geological targets for a thin oil zone.

FIG. 10 illustrates an extension of this technique such that a plurality of geological targets 20*a* to 20*k* are defined along a planned drill path 16*a*. The use of such a technique is desirable, for example, in the case of relatively thin oil zones where a horizontal well is drilled into the reservoir 10. It is important for the well to stay within the oil zone and not, for example, to enter a water zone which would result in the oil production rate being reduced or lost. The geological targets 20*d* to 20*k* are defined in the oil zone. A positive economic value is assigned to points inside the geological targets 20*d* to 20*k* with a large negative value being assigned to points outside these targets. Information can be obtained about the distribution of oil production which is likely to be achieved and this can be assessed against the cost of reducing the drilling or geological uncertainty by further investment. For example, the technique described with reference to FIGS. 7 to 9 may be used in this assessment.

The same type of analysis may be performed in real time. The NPV can be estimated during drilling and evaluated against planned values. A drilled well bore is illustrated at 16*b*. The path is very close to the oil/water contact and the expected NPV would be low. The need for and benefits of a new side-track may be evaluated and executed at an early stage.

The completion of the well may also be changed based on the drilled well bore, uncertainties and the estimated risk of water coning.

What is claimed is:

1. A method of estimating positional uncertainty in drilling a well, comprising:

supplying a first set of values representing a first three-dimensional uncertainty of the actual position of a drill bit with respect to the estimated position thereof;

supplying a second set of values representing a second three-dimensional uncertainty of the actual position of a geological feature with respect to the estimated position thereof;

combining the first and second sets of values to form a third set of values representing a third uncertainty of the position of the drill bit with respect to the geological feature;

calculating from the third uncertainty the probability that the drill bit reaches a predetermined position relative to the geological feature;

defining at least one geological target as a finite surface relative to the geological feature; and correcting at least one value in the first set of values using information from a marker point whose relative position including positional uncertainty to the at least one geological target is at least partly known.

2. The method of claim 1, wherein at least one of the first, second and third sets of values comprises parameters of an error ellipsoid with a predetermined confidence interval referred to a Cartesian coordinate system.

3. The method of claim 1, wherein at least one of the first, second and third sets of values comprises a covariance matrix referred to a Cartesian coordinate system.

4. The method of claim 1, wherein the first and second sets of values are referred to different coordinate systems and the combining step comprises transforming the first and second sets of values to fourth and fifth sets of values, respectively, referred to a common coordinate system end summing corresponding values of the fourth and fifth sets to form the third set of values.

5. The method of claim 1, wherein the probability that the drill bit reaches a predetermined position relative to the geological feature is calculated as a normal distribution.

6. The method of claim 1, wherein the at least one geological target has a boundary defined by a predetermined probability, and wherein the method further comprises the step of deriving a drill target as a sub-surface within the at least one geological target.

7. The method of claim 1, further comprising the steps of:

defining a plurality of geological targets along a drill path;

calculating the probability of the drill path intersecting each of the geological targets; and deriving from the calculated probabilities the probability of the drill path staying within a corridor defined by the geological targets.

8. The method of claim 1, further comprising the step of selecting a desired point of intersection of a drill path with the at least one geological target.

9. The method of claim 8, further comprising the step of calculating the probability of the drill path intersecting the at least one geological target.

10. The method of claim 9, wherein the at least one geological target is a polygon.

11. The method of claim 10, wherein the at least one geological target is rectangular.

12. The method of claim 10, further comprising the step of ascribing a maximum acceptable probability of the drill path missing the at least one geological target to each side of the polygon.

13. The method of claim 1, further comprising the step of calculating the probability of the drill bit being at a predetermined distance from the at least one geological target.

14.The method of claim 1, wherein the marker point is the position of the drill bit during drilling when the drill bit penetrates a seismic reflector whose distance from the at least one geological target is at least partly known.

15. The method of claim 1, wherein the at least one geological target is selected to coincide with a predetermined geological structure, wherein the marker point is disposed at the predetermined geological structure, and wherein the position of the predetermined geological structure is derived from a pilot well.

16. The method of claim 1, further comprising the steps of:

recalculating the probability of the drill path intersecting the at least one geological target after the step of correcting at least one value in the first set of values; and changing the direction of the drill path if the probability of the drill path intersecting the at least one geological target is less than a predetermined value.

17. The method of claim 1, wherein the marker point is observed during drilling using means disposed at or adjacent the drill bit.

18. The method of claim 1, further comprising the step of defining a drill target as a sub-surface within the at least one geological target, and wherein a drill path is directed at a point within the drill target.

19. The method of claim 18, further comprising the step of calculating the probability that the drill path will intersect the at least one geological target.

20. The method of claim 18, further comprising the step of calculating the lowest probability that the drill path will intersect the at least one geological target.

21. The method of claim 18, further comprising the step of calculating the total probability that the drill path will intersect the at least one geological target.

* * * * *